US007898433B2

(12) United States Patent
Roberts

(10) Patent No.: US 7,898,433 B2
(45) Date of Patent: Mar. 1, 2011

(54) TRAFFIC CONTROL SYSTEM

(76) Inventor: Howard H. Roberts, Newtown, PA (US)

( * ) Notice: Subject to any disclaimer, the term of this patent is extended or adjusted under 35 U.S.C. 154(b) by 250 days.

(21) Appl. No.: 11/693,344

(22) Filed: Mar. 29, 2007

(65) Prior Publication Data

US 2008/0238721 A1 Oct. 2, 2008

(51) Int. Cl.
*G08G 1/00* (2006.01)

(52) U.S. Cl. ..... 340/932; 340/907; 340/933

(58) Field of Classification Search ..... 340/932, 340/933, 934, 937, 907, 908, 910, 928; 701/117–119
See application file for complete search history.

(56) References Cited

U.S. PATENT DOCUMENTS

| | | | | |
|---|---|---|---|---|
| 3,750,099 | A | 7/1973 | Proctor | |
| 3,797,450 | A | 3/1974 | Frisbee | |
| 3,829,682 | A | 8/1974 | Geiger | |
| 3,872,423 | A | 3/1975 | Yeakley | |
| 3,941,201 | A * | 3/1976 | Hermann et al. | 340/932 |
| 5,528,234 | A * | 6/1996 | Mani et al. | 340/928 |
| 5,646,853 | A | 7/1997 | Takahashi et al. | |
| 5,673,039 | A * | 9/1997 | Pietzsch et al. | 340/932 |
| 5,864,304 | A | 1/1999 | Gerszberg et al. | |
| 6,498,981 | B1 * | 12/2002 | Adams | 340/907 |
| 7,150,552 | B2 | 12/2006 | Weidel | |
| 2004/0047685 | A1 * | 3/2004 | Van Der Poel | 404/9 |

* cited by examiner

*Primary Examiner*—Thomas J Mullen
(74) *Attorney, Agent, or Firm*—Nydegger & Associates

(57) ABSTRACT

A system and method for moving vehicular traffic in a single lane through a control zone requires creation of a control protocol. The protocol establishes a spacing distance "s" and a speed "v" for each vehicle in the control zone. A computer then controls movement of a visible signal through the control zone in accordance with the established protocol. Electronic regulators monitor the distance "s" between the signal and the vehicle, and the system alarms when "s" becomes greater than a predetermined distance "d".

16 Claims, 3 Drawing Sheets

TRAFFIC CONTROL SYSTEM

FIELD OF THE INVENTION

The present invention pertains generally to systems and methods for controlling vehicular traffic in congested areas. More particularly, the present invention pertains to systems and methods that provide visual signals for use in maintaining a substantially constant speed and a substantially constant spacing for vehicles as they traverse a control zone. The present invention is particularly, but not exclusively, useful as a system and method for the control of vehicular traffic through roadway anomalies such as bridges, tunnels and construction sites.

BACKGROUND OF THE INVENTION

Traffic control in congested areas is a major concern for all involved. Not surprisingly, traffic congestion is all too often exacerbated by the traffic itself. Either drivers become impatient and indulge in lane changes, or they are simply overwhelmed by situational variations that cause them to engage in erratic speed changes. Both responses (i.e. lane changes and speed changes) are very detrimental to smooth traffic flow. In almost every case, the consequence is a drastic diminution in traffic throughput from a theoretical maximum to an actual throughput that is around fifty to seventy percent of the theoretical maximum.

By way of example, a single lane of traffic in a congested area, with a posted speed limit of 60 mph and a constant spacing between vehicles of six car lengths, can theoretically accommodate 3,232 vehicles per lane, per hour. Due to the traffic friction caused by lane changes and speed variations, however, the actual traffic throughput under these conditions will more realistically be in a range between about 1,900 and 2,200 vehicles per lane per hour. Fortunately, congested areas can be easily identified and will typically be found in tunnels, on bridges, and through construction sites. Moreover, they are typically only a few miles long, at most. Nevertheless, they pose the real possibility of creating traffic "bottlenecks" that can be very disruptive.

In light of the above, it is an object of the present invention to provide a system and a method for moving vehicular traffic through an area of potential congestion that effectively maintains a steady flow of traffic. Another object of the present invention is to provide for a steady traffic flow in a control zone by establishing a spacing distance and a speed for each vehicle as it passes through the control zone. Yet another object of the present invention is to provide a system and method for controlling vehicular traffic that is easy to implement, is simple to use, and is comparatively cost effective.

SUMMARY OF THE INVENTION

A system and method for controlling vehicular traffic in accordance with the present invention requires the establishment of a control protocol. Specifically, a control protocol is established for each individual vehicle that will be entering a control zone. In accordance with the present invention, this protocol involves determining a safe stopping distance "sd" for each vehicle, and establishing a speed "v" at which the vehicle is required to proceed through the control zone. For the present invention, implementation of the control protocol is accomplished by moving a signal through the control zone at the speed "v", establishing a distance "d" between consecutive signals, and monitoring the spacing distance "s" at which each vehicle follows its dedicated signal. As envisioned for the present invention, the distance "d" between consecutive signals is determined by three considerations. These are: 1) a guesstimate of the distance a vehicle will follow its dedicated signal; 2) the length of the vehicle; and 3) the safe stopping distance of the next-in-line vehicle.

Structurally, the system of the present invention includes a sensor that is located on the roadway ahead of the control zone. Preferably, this sensor will be a series of inductive coils or pneumatic tubes that are laid down on the roadway, or embedded in the roadway. The purpose of the sensor is to determine whether a vehicle is approaching the threshold of the control zone and, if so, its overall length "l". Further, based on its length "l", a safe stopping distance "sd" can be estimated for the vehicle. Additionally, the system includes a plurality of regulators that are strategically positioned along the roadway in the control zone. The purpose of these regulators is to monitor the movement of each individual vehicle and, in particular, the spacing distance "s" at which each vehicle respectively follows its dedicated signal.

An essential structural component of the system is a conveyor and its associated signal. In detail, the conveyor will be a mechanism that is positioned along the lane of traffic in the control zone for moving a visible signal through the control zone at the speed "v". As envisioned for the present invention, the combination of conveyor and signal can have any of several embodiments. For one, the conveyor can be a row of laser light emitters. In this case the signal will be a beam of laser light. For another, the conveyor can be a row of incandescent or fluorescent lights. In this case the signal will be a moving point of light. For yet another embodiment, the conveyor can be a moving track or belt and the signal can be a pop-up flag that will move on the track or belt through the control zone. Importantly, a separate signal is provided for each control protocol. And, the signals for a contiguous sequence of control protocols can each have a unique identifier (e.g. a different color). Further, as envisioned for the present invention, the conveyor can be positioned on the roadway, beside the roadway, or on support structures over the roadway.

Functionally, the system of the present invention employs a computer for coordinating the various operations of the system's other components. Specifically, as a vehicle approaches the threshold of the control zone, the computer is alerted by the sensor to create a control protocol for the vehicle. Based on the vehicle's length "l", as determined by the sensor, a safe stopping distance "sd" is established by the computer for the vehicle. Also, the distance between signals "d" is established by the computer. Next, when the vehicle arrives at the control zone threshold, the computer activates a signal on the conveyor. This signal is then moved by the conveyor through the control zone at the speed "v", and the vehicle follows the signal.

During the movement of a vehicle through the control zone, the regulators that are positioned along the roadway monitor the vehicle's progress. More specifically, they are used to monitor the distance "s" between the vehicle and its dedicated signal. In the unlikely event a vehicle either overruns its dedicated signal, or drops behind its dedicated signal by more than a calculable distance, the computer will create an alarm. Initially, actions will be taken to encourage the vehicle driver to restore the vehicle to its correct distance "s".

If the driver does not do so, then the computer will adjust the speed "v" for upstream and downstream vehicles to maintain maximum flow.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
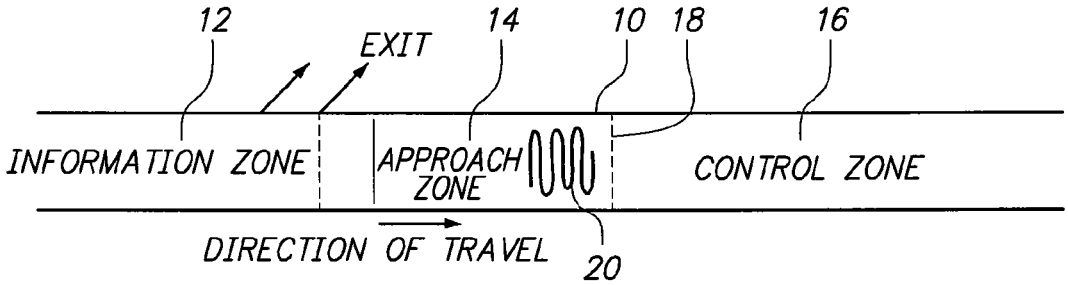
FIG. 1 is a schematic of a roadway for vehicular traffic identifying various zones used by the present invention for the control of traffic.

Referring initially to FIG. 1 a roadway is shown organized for purposes of the present invention and is designated 10. As shown, a lane of traffic for the roadway 10 includes three different zones that are individually identified according to their function. First, there is an information zone 12 wherein drivers are informed of upcoming traffic control requirements. This information can be provided with signs and other traffic control devices (not shown). For drivers who do not wish to proceed, an exit is provided before they enter the approach zone 14. Upon entering the approach zone 14, the driver becomes committed to progressing through the downstream control zone 16. As indicated, the transition from approach zone 14 to control zone 16 is delineated by a threshold 18. In the approach zone 14, speed requirements are posted, and a sensor 20 is used to determine the length and speed of each vehicle. As envisioned for the present invention, the sensor 20 can be a series of inductive loops or pneumatic tubes that are positioned either on the roadway 10, or embedded in the roadway 10. In any event, by the time a vehicle 22 passes the threshold 18, its general overall length "l" has been determined by the sensor 20. The vehicles 22*a*, 22*b*, and 22*c* shown in FIG. 2A are only exemplary of various type vehicles that may be controlled by the present invention.

Figure 2A:
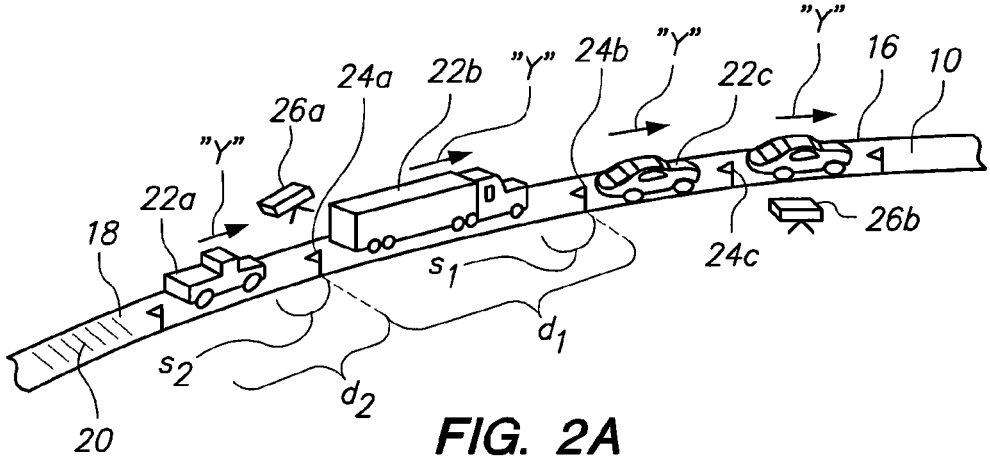
FIG. 2A is a perspective view of a column of traffic traveling along a single lane of the roadway through a control zone.
Figure 2B:
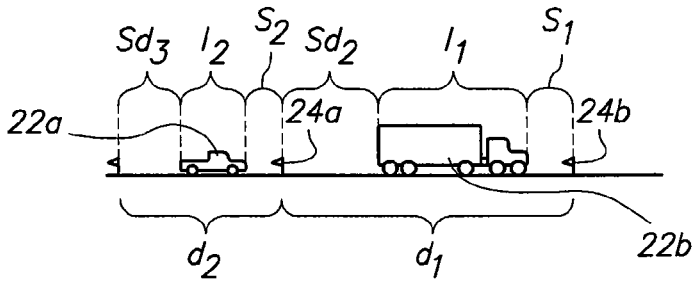
FIG. 2B is an elevation view of two vehicles traveling in the control zone.

In FIG. 2A a plurality of vehicles 22 are shown traveling in the control zone 16. Specifically, it will be seen that each vehicle 22 is following a respectively dedicated signal 24. For example, the vehicle 22*a* is shown following a signal 24*a*, while the vehicles 22*b* and 22*c* are shown following respectively dedicated signals 24*b* and 24*c*. In further detail, the signal 24 is moved through the control zone 16 by a conveyor that is positioned along the lane of traffic and is used as a mechanism for moving signals. The conveyor (mechanism) can be positioned either on the roadway 10, or beside the roadway 10. As envisioned for the present invention, the signal 24 can be any one of several different type signals. Examples of various type signals that are suitable for the present invention are disclosed in greater detail below. The illustration of the signals 24*a*, 24*b* et seq. as being pop-up flags in FIGS. 2A and 2B is only for exemplary purposes. Other embodiments of the types of signals that can be utilized are shown in FIGS. 4A-4D.

Still referring to FIG. 2A, it will be seen that in addition to following its own dedicated signal 24, each vehicle 22 travels within a distance "d" that is measured between consecutive signals 24. Importantly, the determination of the distance "d" for a vehicle 22 takes into account the safe stopping distance "sd" of the immediately following vehicle. For purposes of this disclosure, a subscript "1" is used with reference to a leading vehicle, and a subscript "2" is used with reference to its next-in-line, immediately following vehicle (et seq.). With this in mind, consider the two vehicles 22*a* and 22*b* shown in FIG. 2B.

In FIG. 2B, the length "$l_1$" of vehicle 22*b* is determined as it passes over the sensor 20 prior to arriving at the threshold 18. This length "$l_1$" is then used to calculate a safe stopping distance "$sd_1$" for the vehicle 22*b*. Using a guesstimate for "s" a distance "$s_{g1}$" is established for the vehicle 22*b*. The distance "$d_1$" will then be the sum of "$s_{g1}$", "$l_1$" and "$sd_2$" ($d_1 \geqq s_{g1}+l_1+sd_2$). Stated differently, the distance $d_1$ will be used as a minimum distance between the signal 24*b* that the vehicle 22*b* follows and the next consecutive signal 24*a*. Similarly, the minimum distance "$d_2$" for vehicle 22*a* will be the sum of "$s_{g2}$", "$l_2$" and "$sd_3$" ($d_2 \geqq s_{g2}+l_2+sd_3$).

In addition to establishing the distance "d" between consecutive signals 24 (e.g. the distance between signal 24*a* and signal 24*b*), the control protocol for the present invention needs to be continuously evaluated as the vehicle 22 proceeds through the control zone 16. More specifically, as noted above, the actual distance "$s_{1,2}$" at which a vehicle 22 follows its dedicated signal 24 is monitored by the regulators 26*a,b*. When the vehicle 22 either overtakes a signal 24, or it falls behind so there is an unsafe distance between the vehicle 22 and the signal 24 behind the vehicle 22, an alarm should sound. Mathematically these conditions can be respectively expressed for a lead vehicle as: $s_1=0$ [overtaking]; and $d_1-l_1-s_1<sd_2$ [falling behind].

As mentioned above, compliance with the control protocol is monitored along the length of the control zone 16 by a series of regulators 26. The regulators 26*a* and 26*b* shown in FIG. 2A are exemplary. As envisioned for the present invention, the regulators 26 may be any device well known in the pertinent art that can monitor the distance "s" for each vehicle 22, such as a video camera. Further, these regulators 26 can be conveniently positioned along the control zone 16, as required.

Figure 3:
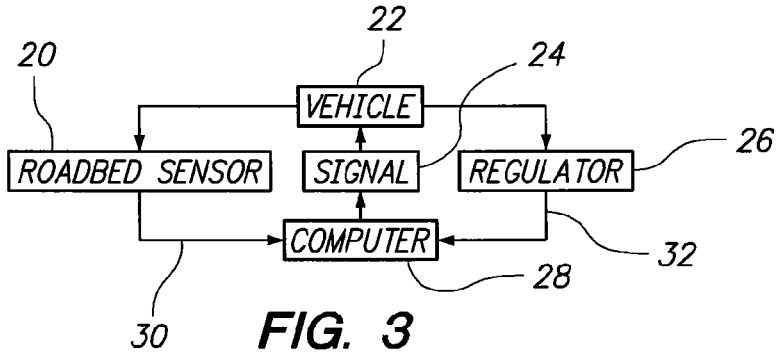
FIG. 3 is a schematic showing the inter-relationships of components for the present invention.

FIG. 3 indicates that the present invention, with its control protocols, can be centrally managed by a computer 28. As shown in FIG. 3, for this interaction each vehicle 22 provides input to the computer 28 via the roadbed sensor 20 and the regulators 26. On the other hand, the computer 28 provides input to the vehicle 22 via the signal 24 (i.e. in accordance with a control protocol).

To initiate a control protocol, the line 30 in FIG. 3 indicates that with input from the sensor 20 (i.e. vehicle length "l"), the computer 28 is able to establish a value for the safe stopping distance "sd" of the vehicle 22. Recall, this is done for each vehicle 22. Using "l" of the lead vehicle (i.e. $l_1$) and the safe stopping distance of the following vehicles (i.e. $sd_2$), in addition to a guesstimate value for "s" (i.e. "$s_{g1}$") a distance between signals "$d_1$" is calculated for the lead vehicle. Then, as the vehicle 22 traverses the control zone 16, the regulators 26 monitor the actual value for "s". When either $s_1=0$, or the expression $d_1-s_1-l_1<sd_2$ is satisfied, the line 32 in FIG. 3 indicates the computer 28 can use this information to activate an alarm for the computer operator (i.e. computer 28). The computer 28 will then appropriately adjust any or all control protocols, as required.

As mentioned above, several types of signals 24 can be used for purposes of the present invention. Further, although the present invention is intended to separately control single lanes of traffic, the present invention is adaptable to a multi-lane roadway 10. As shown in FIGS. 4A-D the roadway 10 may have side-by-side lanes, such the lanes 34*a* and 34*b*. In this event, a different signal 24 may be used simultaneously by different vehicles 22 in the respective lanes 34*a* and 34*b*. Consequently, the control protocols for the vehicles 22 that are using different signals 24 will also be different.

Figure 4A:
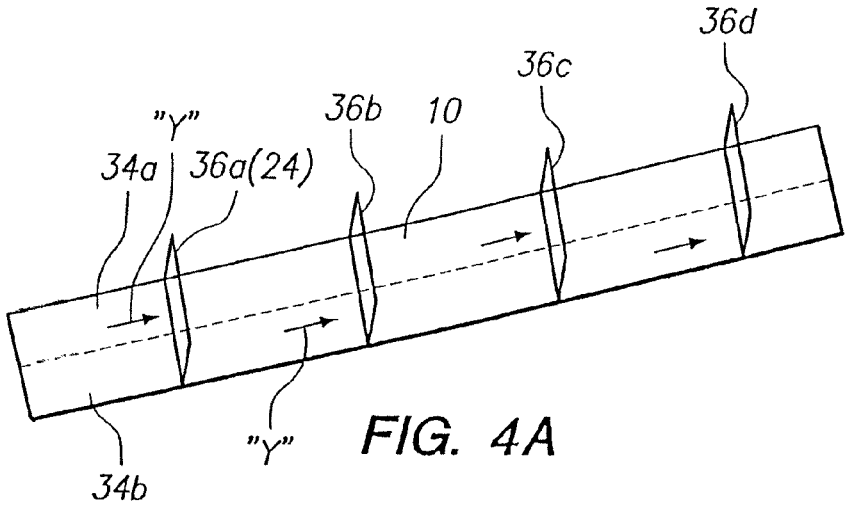
FIG. 4A is a drawing of a control protocol of the present invention employing laser beam signals positioned along the roadway in the control zone.
Figure 4B:
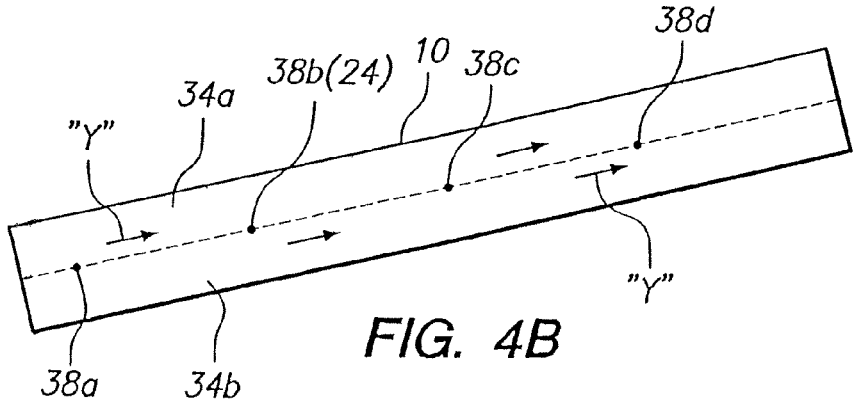
FIG. 4B is a drawing of a control protocol of the present invention employing light point signals positioned along the roadway in the control zone.
Figure 4C:
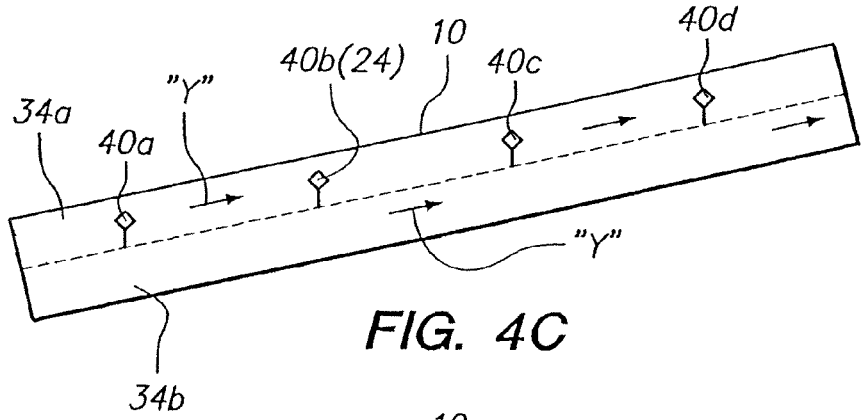
FIG. 4C is a drawing of a control protocol of the present invention employing pop-up flag signals positioned along the roadway in the control zone.
Figure 4D:
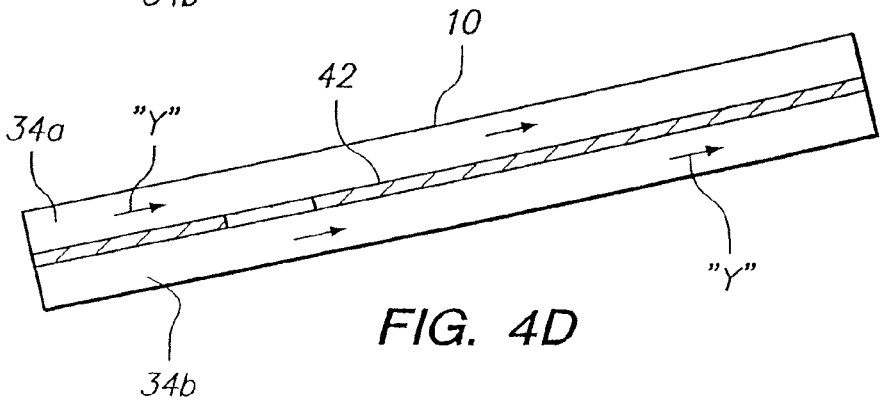
FIG. 4D is a drawing of a control protocol of the present invention employing color strip signals painted on the roadway in the control zone.

Examples of the various type signals 24 that can be employed for the present invention are shown in FIGS. 4A-D with each of these figures generally designated as conveyor 11*a-d*. These include: a laser beam 36*a-d* (FIG. 4A); a point of light 38*a-d* (FIG. 4B); or a pop-up flag 40*a-d* (FIG. 4C). The a-d designations more clearly depict how the signal moves through the control zone with the signal designated "a" appearing first and the signal designated "d" appearing last. Only one signal is present at a time as the vehicle follows the moving signal through the control zone. In each case, the signal 24 is moved through the control zone 16 at a speed "v" according to the established control protocol. Further, consecutive signals 24 can each have a unique identifying feature, such as different colors. As an alternative or augmentation to the moving signals 24 (FIGS. 4A-C), FIG. 4D shows that a series of colored strips 42 can be painted on the roadway 10. If such strips are used, the vehicles 22 can be informed in the information zone 12 that at least one, but no more than two colored strips should be visible from behind the vehicle 22 that is being followed.

Figure 5:
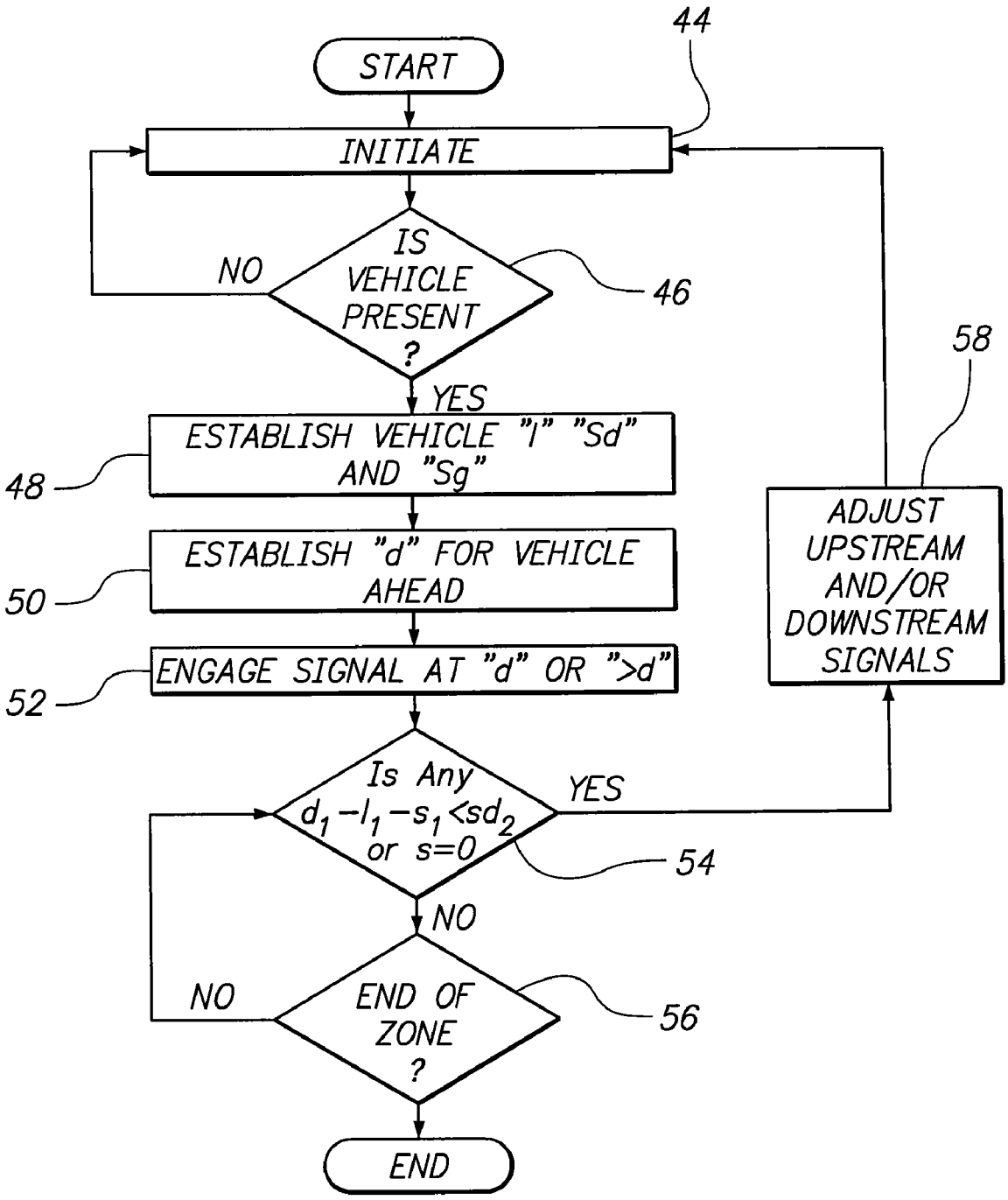
FIG. 5 is a logic flow chart showing the methodology steps employed by the present invention.

Implementation of the control protocols of the present invention will be best appreciated by reference to FIG. 5. In FIG. 5, the action block 44 and inquiry block 46 together indicate that a control protocol is initiated when a vehicle 22 is present in the approach zone 14. When a vehicle 22 is present in the approach zone 14, the computer 28 will perform the functions indicated by blocks 48, 50 and 52. Specifically, block 48 indicates that after a vehicle has been detected, but prior to entering the control zone 16, the length "l" of the vehicle is determined. This length "l" is then used to establish a safe stopping distance "sd" for the vehicle, and it is used to generate a guesstimate "$s_g$" of the distance the vehicle will follow its dedicated signal 24. Block 50 then indicates that a distance "d" is established for the lead vehicle (i.e. the vehicle immediately preceding the vehicle that is entering the control zone 16). More specifically, this distance will be established by the expression "$d_1=l_1+s_{g1}+sd_2$", wherein "$sd_2$" is the safe stopping distance of the next following vehicle (i.e. the vehicle that is entering the control zone).

During transit of a vehicle 22 through the control zone 16, the regulators 26 monitor the spacing distance "s". Specifically, the computer 28 continuously determines whether any vehicle 22 has overtaken the signal 24 it is following (i.e. s=0) or whether the vehicle 22 has fallen behind (i.e. $d_1-l_1-s_1<sd_2$) (inquiry block 54). If neither of these has happened in the control zone 16, the inquiry block 56 indicates that the control protocol has ended, and the vehicle 22 exits the control zone 16. On the other hand, if either s=0, or $d_1-l_1-s_1<sd_2$, block 58 indicates that an adjustment may be required for both upstream and downstream signals 24 (i.e. the control protocols for vehicles 22 that are in front of and behind the errant vehicle 22 are re-evaluated). In most instances, this can be accomplished merely by changing the required "v" at which the conveyor (mechanism) is moving the signals 24 through the lane for the affected control protocols. Importantly, the computer 28 needs to be capable of simultaneously managing a plurality of control protocols.

While the particular Traffic Control System as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A system for moving a plurality of vehicles in a single lane of traffic on a roadway through a control zone which comprises:

a sensor for determining an approach of each vehicle to a threshold of the control zone;

a plurality of signals wherein each signal moves at a distance "s" ahead of a corresponding one of said vehicles through the control zone for managing the movement of the corresponding vehicle at a speed "v" determined for each signal;

a control protocol established for each vehicle entering the control zone wherein the control protocol establishes and continuously updates a safe stopping distance "sd" and a distance "d" between consecutive ones of said signals based on the length "l" of the corresponding vehicle and the distance "s";

a regulator for monitoring the distance "s" between each vehicle and the corresponding signal; and a computer connected to the sensor for initiating the control protocol for each vehicle at the threshold, wherein the computer establishes the speed "v" for moving each signal, and further wherein the computer is connected to the regulator to create an alarm when the distance "s" creates a predetermined condition.

2. A system as recited in claim 1 wherein the plurality of signals is a row of laser light emitters positioned along the lane of traffic in the control zone, and each signal is a laser beam.

3. A system as recited in claim 1 wherein the plurality of signals is a row of lights positioned along the lane of traffic in the control zone and each signal is a light beam.

4. A system as recited in claim 1 wherein the plurality of signals is a sequence of pop-up flags mounted on a track, wherein the track is for movement of pop-up flags through the control zone.

5. A system as recited in claim 1 wherein each of the plurality of signals for a contiguous sequence of control protocols has a different color.

6. A system as recited in claim 1 wherein each signal is selectively activated and is dedicated to a single control protocol.

7. A system as recited in claim 1, wherein a next-in-line vehicle (subscript 2) follows a lead vehicle (subscript 1), and wherein the sensor establishes a length "$l_2$" for the next-in-line vehicle, and a safe stopping distance "$sd_2$" based on "$l_2$" for the next-in-line vehicle, wherein a next-in-line signal follows at a distance "$d_1$" behind a lead signal for the lead vehicle, wherein $d_1=l_1+s_1+sd_2$, and further wherein a first predetermined condition occurs when $s_2=0$, and a second predetermined condition occurs when $d_1-l_1-s_1<sd_2$.

8. A system as recited in claim 1 wherein the plurality of signals is mounted on the roadway.

9. A system as recited in claim 1 wherein the plurality of signals is mounted above the roadway.

10. A system for moving a vehicle in a single lane of traffic on a roadway through a control zone which comprises:

a means for determining an approach of the vehicle to a threshold of the control zone;

a means for establishing a control protocol based on a length "l" for each vehicle, wherein the control protocol includes a spacing distance "s", for spacing between the vehicle and a signal, and a speed "v", for movement of the signal along the lane through the control zone;

a means for activating the signal;

a mechanism for moving the signal through the control zone in accordance with the control protocol;

a means for monitoring the distance "s" between the vehicle and the signal; and a means for creating an alarm when the distance "s" creates a predetermined condition.

11. A system as recited in claim 10 wherein the signal is a light source in a plurality of aligned light sources and the signal is a visible, moving light indicator.

12. A system as recited in claim 10 wherein the determining means establishes a length "$l_2$" for the vehicle, and a safe stopping distance "$sd_2$" based on "$l_2$" for the vehicle, wherein the signal follows at a distance "$d_1$" behind a lead signal for a lead vehicle (subscript 1), wherein $d_1=l_1+s_1+sd_2$, and further wherein a first predetermined condition occurs when $s_2=0$, and a second predetermined condition occurs when $d_1-l_1-s_1<sd_2$.

13. A system as recited in claim 10 wherein signals for a contiguous sequence of control protocols each have a different color, and wherein each signal is selectively activated and is dedicated to a single control protocol.

14. A method for moving a vehicle in a single lane of traffic on a roadway through a control zone which comprises the steps of:

determining an approach of the vehicle to a threshold of the control zone;

establishing a control protocol based on a length "l" for each vehicle, wherein the control protocol includes a spacing distance "s", for spacing between the vehicle and a signal, and a speed "v", for movement of the signal along the lane through the control zone;

activating the signal to control the movement of the vehicle through the control zone;

moving the signal through the control zone with a conveyor in accordance with the control protocol;

monitoring the distance "s" between the vehicle and the signal; and creating an alarm when the distance "s" creates a predetermined condition.

15. A method as recited in claim 14 wherein the conveyor is a plurality of aligned light sources and the signal is a visible, moving light indicator.

16. A method as recited in claim 14, wherein a next-in-line vehicle (subscript 2) follows a lead vehicle (subscript 1), and wherein the determining step is accomplished by establishing a length "$l_2$" for the next-in-line vehicle, and a safe stopping distance "$sd_2$" based on "$l_2$" for the next-in-line vehicle, wherein the moving step involves placing the signal at a distance "$d_1$" behind a lead signal for the lead vehicle, wherein $d_1=l_1+s_1+sd_2$, and further wherein the creating step is accomplished when a first predetermined condition occurs when $s_2=0$, and when a second predetermined condition occurs when $d_1-l_1-s_1<sd_2$.

* * * * *